United States Patent [19]

Hess et al.

[11] Patent Number: 4,535,702

[45] Date of Patent: Aug. 20, 1985

[54] ARTICULATED RAILWAY VEHICLE

[75] Inventors: Fritz Hess, La Tour-de-Peilz; Fernand Dalliard, Villeneuve, both of Switzerland

[73] Assignee: Ateliers de Constructions Mecaniques de Vevey S.A., Vevey, Switzerland

[21] Appl. No.: 323,477

[22] Filed: Nov. 20, 1981

[30] Foreign Application Priority Data

Jul. 30, 1981 [CH] Switzerland ..... 4934/81

[51] Int. Cl.[3] ..... B61D 17/10; B61D 19/00; B61D 23/02

[52] U.S. Cl. ..... 105/4 R; 105/182 R; 105/343; 105/398

[58] Field of Search ..... 105/3, 4 R, 182 R, 343, 105/183, 398

[56] References Cited

U.S. PATENT DOCUMENTS

| | | | |
|---|---|---|---|
| 588,563 | 8/1897 | Finley | 105/398 |
| 1,265,367 | 5/1918 | Paul et al. | 104/4 R X |
| 1,412,075 | 4/1922 | Way | 105/4 R |
| 1,696,332 | 12/1928 | Sheehan | 105/398 X |
| 2,166,858 | 7/1939 | Bugatti | 105/182 R |
| 3,516,365 | 6/1970 | Lich | 105/182 R X |
| 3,523,505 | 8/1970 | Lich | 105/182 R |
| 4,173,933 | 11/1979 | Kayserling | 105/182 R |

FOREIGN PATENT DOCUMENTS

| | | | |
|---|---|---|---|
| 247907 | 1/1948 | Switzerland | 105/183 |

*Primary Examiner*—Howard Beltran
*Attorney, Agent, or Firm*—Emory L. Groff, Jr.

[57] ABSTRACT

A railway vehicle for urban use has at least one motorized truck and at least one non-motorized supporting truck. The supporting truck is provided with wheels of smaller diameter than the wheels of the motorized truck which enables a lowering of all of the floor area of the vehicle except the portion which lies above the motorized truck. This lowering of the floor permits the use of a single intermediate step to be utilized by passengers and expedites their entry into and exit from the vehicle.

1 Claim, 9 Drawing Figures

W
W'
R
A
17
18
19
20

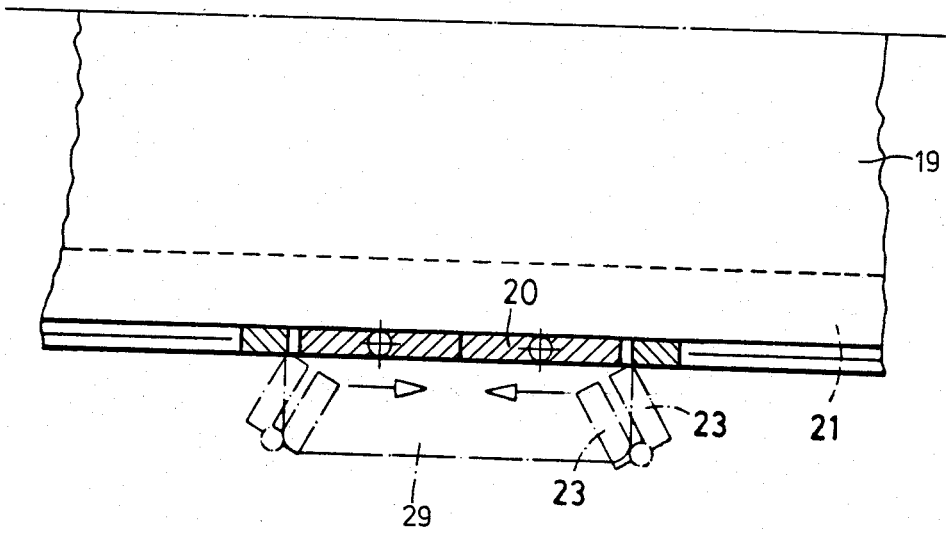
Fig.7
Fig.8
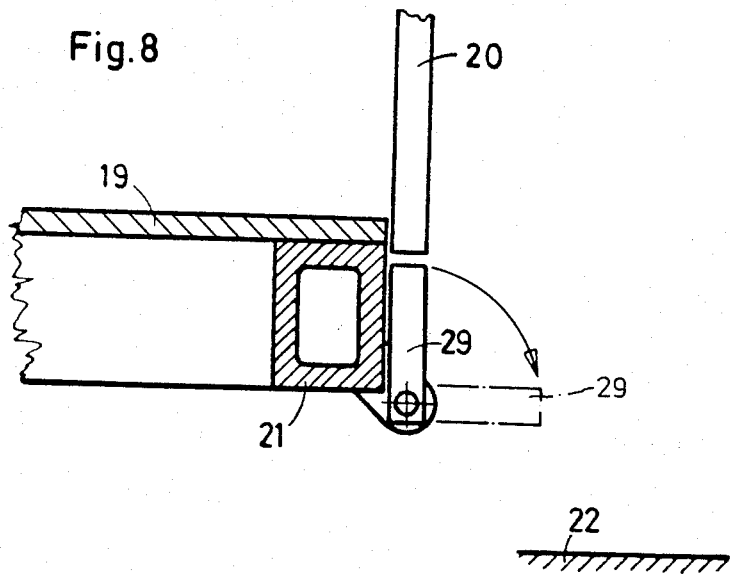

ARTICULATED RAILWAY VEHICLE

Streetcars or trams used for rapid transportation of people in large cities must be designed in a manner such that the passengers can rapidly board them and get out of them at a station. Presently known vehicles have a floor the level of which is high because of the size of the required drive wheels. The result of which is that people enter the car through the use of at least three steps, a situation which slows down their entering and leaving the vehicle and which is especially inconvenient for persons who are less agile than others.

The object of the present invention is to overcome the aforementioned disadvantage through the construction of rail vehicles, especially streetcars for urban transit use, the floor of which is appreciably lower than the floor of such vehicles now in use and which can be entered from the sidewalk through a single intermediate step, that is to say by means of two steps only. The invention also relates to a truck for rail vehicles which, being for support only, is constructed in a manner such that, even in the absence of a primary resilient suspension, the load is evenly distributed among the four wheels which may be of a very small diameter, a situation which makes possible an important lowering of the floor, and the largest part of its surface.

Another advantage of the invention resides in the fact that the reduction of the number of steps to only two makes it possible to eliminate the stairwell which exists in known constructions, which well provides access to the door. Also, the invention makes possible the construction of the lowered floor on one and the same level close to the doors. The two steps taken to get down from the vehicle being possible with the help of a single necessary intermediate footboard which is retractable and can be placed outside of the vehicle. The elimination of the stairwell further makes it possible to utilize the edge stringer of the floor in a rectilinear manner, which is more economical.

More specifically, the invention relates to a rail vehicle, especially one for urban transit, the casing or frame of which, which is made up of one or more sections, comprises a floor bordered on each side by a stringer, walls fitted with doors and windows and a roof. The vehicle is supported by at least two trucks at least one of which is non-motorized and is only a supporting truck, characterized in that the supporting truck is equipped with small diameter wheels which provides a significant lowering of the level of the floor of the vehicle at a right angle to the zone corresponding to that truck. The lowering of the level of the floor is sufficient so that only a single stepboard, placed at a level located halfway between the street level and the floor of the vehicle, is necessary to permit access to and exit from the vehicle for the passengers thereof.

These and other objects of the invention will become more readily apparent from the following detailed description taken in conjunction with the accompanying drawings in which:

FIG. 7 is a partial plan view of an access door for the vehicle;

FIG. 8 is a partial transversal section of a streetcar showing its door in closed position and a folding step in retracted position.

Figure 1:
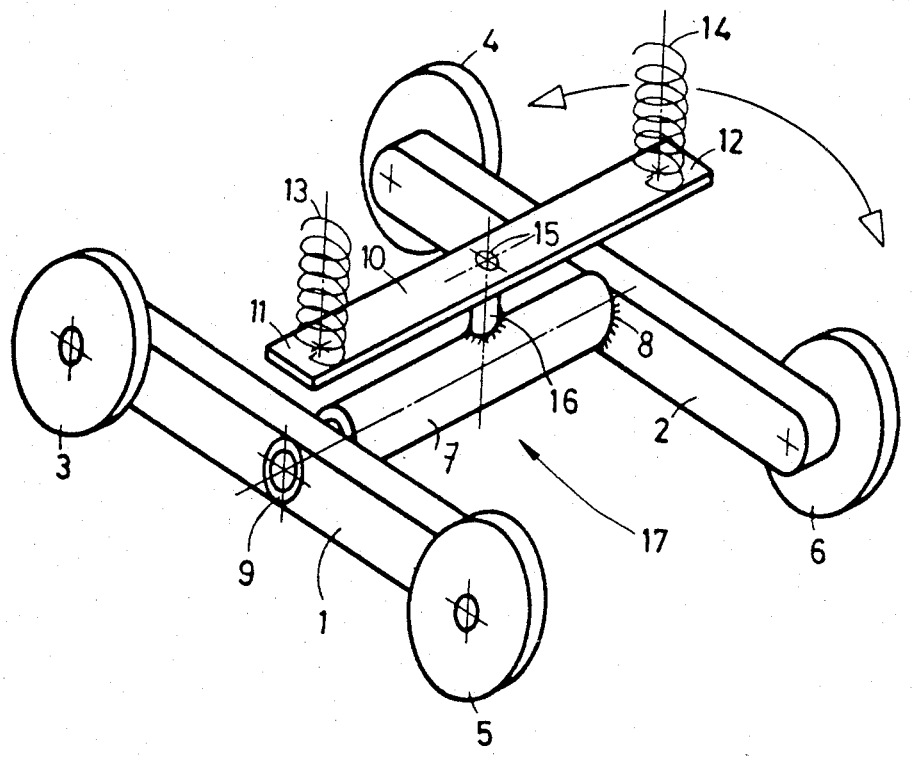
FIG. 1 is a schematic perspective view of the truck embodying the invention.

FIG. 1 illustrates schematically, by way of example, a very safe supporting truck 17 in the sense that it can pass over areas where the rails of the track are banked, and the truck is provided with small wheels necessary for construction of the vehicle. The supporting truck comprises two longitudinal beams each of which includes at opposite ends, a front and rear wheel. As shown in FIG. 1, the wheels are shown as being mounted in an overhanging manner at each end of the two longitudinal beams 1 and 2. Thus, the wheels are independently disposed. Another arrangement could have been possible, particularly the connecting of the two front wheels 3,4 and of the two rear wheels 5,6 to each other by an axle affixed to the ends of the longitudinal beams 1 and 2 by a swivel joint which makes possible independent vertical motions of the wheels. The truck as shown in FIG. 1 is shown without any brakes. However, it is obvious that the wheels can be equipped with brakes the action of which may be exerted on the external surface of the wheel or by other types of brakes which are well known.

The two longitudinal beams 1 and 2 are connected to each other by a first cross beam 7 which, in the case of FIG. 1, is fixedly connected such as by welding at 8 at one of its ends, at the middle of the length of the beam 2 while at the other end of the beam, the connection with the middle of beam 1 is accomplished by means of a guide bearing 9 which permits articulation or oscillation of the longitudinal beam 1 around the horizontal axis of the first cross beam 7. That degree of freedom makes possible, without it being necessary to use a spring suspension for the wheels, the movement of such a truck on banked rails, that is to say two rails which are not in the same plane. In such a case, the two longitudinal beams 1 and 2 remain parallel to the corresponding rails, the differential angle existing between the rails being absorbed by a rotation occuring at the level of the bearing 9.

Midway of its length, the first cross beam 7 includes a support 16 comprising a vertical tube rigidly welded to said first cross beam 7. Said support 16 terminates in a lug 15 which is rotatable and is connected to the center of a second cross beam 10. The connection is disposed in such a manner that said second cross beam 10 can oscillate around a vertical axis, but cannot tilt. The ends 11 and 12 of the second cross beam 10 provide a support which receives a resilient suspension in the form of coil springs 13 and 14, on which is supported the body of the vehicle not represented in the drawing. Also, instead of using this type of spring, it is possible to utilize numerous other systems, for example blade-type springs, rubber or pneumatic springs, etc.

The operation of the unit is as follows:

The two springs 13,14 absorb the vertical shocks which occur during the rolling of the vehicle, and improve the comfort of the ride. They transmit the weight of the body to the two ends 11,12 of the second cross beam 10 which in turn places the weight of the body on the rotating lug 15 then on to support 16, then on to the first cross beam 7. That is to say, the load is located at a point in the center of the first beam 7 and in the center of the wheel base of the truck. In this manner, said load is evenly distributed among the four wheels of the truck due to the rotation of the first beam in the guide bearing 9. In a curve, when the body of the vehicle temporarily takes on a direction different from that of the truck, said difference is absorbed by a rotation which occurs at the level of lug 15. The inclination of the body relative to the plane of the truck is absorbed by the right and left spring suspensions 13 and 14.

FIG. 1 shows a schematic arrangement in which the two cross beams 7 and 10, the support and lug 16 and 15 respectively and the spring suspensions 13 and 14 are arranged one above another for the sake of clarity. In fact, in practice the aforesaid parts are preferably imbricated into one another (not shown).

Figures 2, 3, 4, 5, 6:
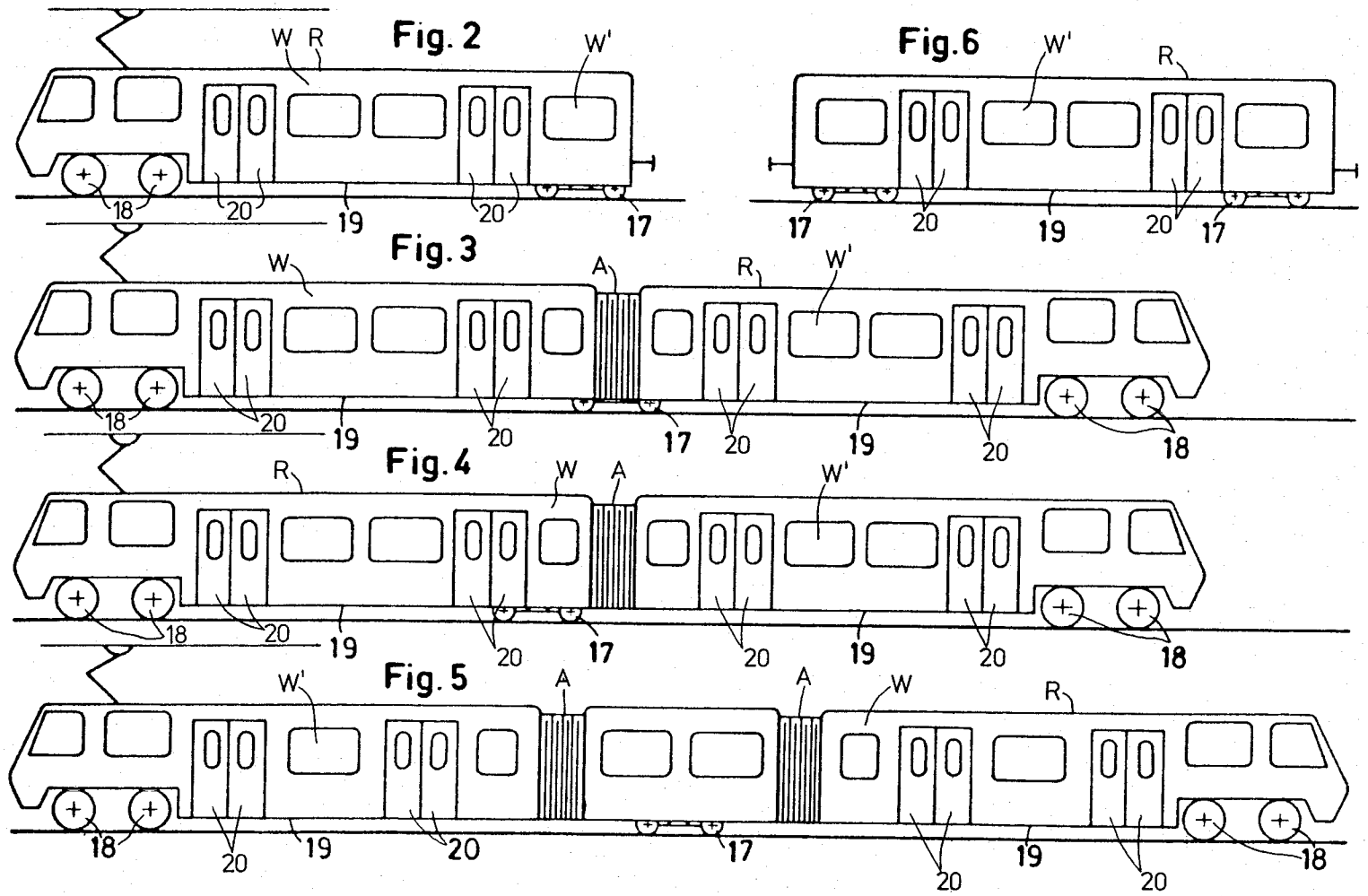
FIG. 2 is a side view of a streetcar provided at one end with a motor driven truck, the other end being provided with a supporting truck.
FIGS. 3 to 5 are side views of streetcars provided at both ends with a motor driven truck and with one supporting truck in various places between the motor driven trucks.
FIG. 6 is a side view of a streetcar trailer with a supporting truck at its both ends.

The above described truck makes it possible to balance the loads on the four wheels, without the necessity for any substantial primary resilient suspension which should make it possible to compensate for the banking of the tracks. This special arrangement makes possible the provision of wheels having a very small diameter and consequently also the construction of rail vehicles the floor 19 of which is definitely lowered over all of its surface in the case of trailer cars (FIG. 6) and over most of its surface in the case of vehicles comprising a single motor driven truck 18, (FIG. 2) and two motor driven trucks 18 as in FIGS. 3, 4 and 5.

In all of the vehicle embodiments illustrated herein, each section thereof comprises a frame including a roof R and walls W provided with windows W'. In the case of the embodiments of FIGS. 3–5, articulation means A, operating on a vertical axis serves to join adjacent sections of the vehicle.

The above arrangement provides the advantage of making the floor in the entire area where it is lowered, at one and the same level the adjacent street 22, close to the entrance doors 20 and to make possible entrance with the help of a single intermediate step 29 which can be a retractable step board located outside of the body, as seen in FIGS. 7 and 8. The floor 19 of the body rests on a framework of beams including a rectilinear lower edge stringer 21 which borders the side edges of the floor and which extends from one end to the other of the lowered part of the body, without being interrupted by a well with one step. The doors 20 comprise a plurality of leaves 23 in a known manner.

Figure 9:
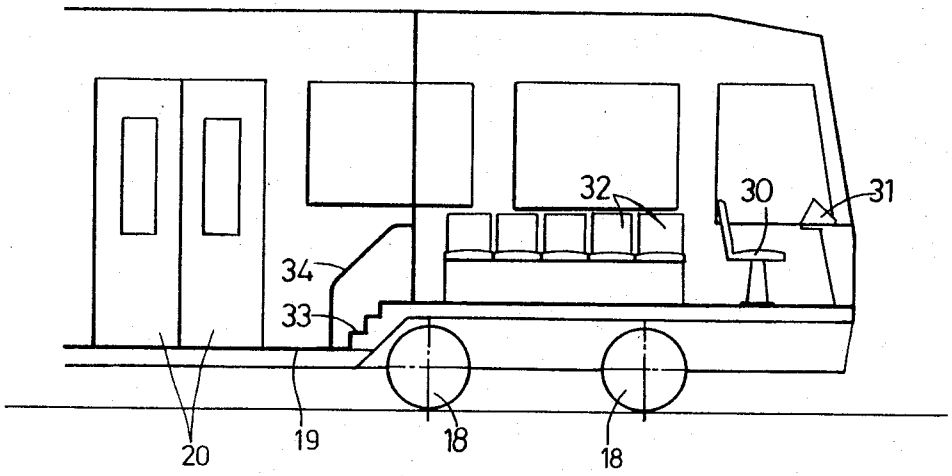
FIG. 9 is a vertical section along the longitudinal axis of the vehicle.

FIG. 9 shows one end of the vehicle comprising a motor driven truck 18 the wheel diameter of which must be sufficient to obtain the necessary traction, a situation which requires the level of the floor covering the motor trucks to be appreciably higher than that of the remainder of the vehicle. A vehicle of this type includes a front stair 33 having, as illustrated, two intermediate steps making it possible for the driver and passengers to have access to seats 30 and 32. A handrail 34 is provided thus making it easier to climb the steps.

We claim:

1. A railway vehicle, particularly adapted for urban use with access to and exit from and to a street, comprising, a frame including at least two sections adjacent each other, articulation means on a vertical axis connecting said sections to each other, each said section provided with a floor extending the length of said respective sections, stringers supporting each floor along its longitudinal edges, walls fitted with doors and windows, a roof connected to said walls, a single folding step provided at a level mid-way between the street and said floor of the vehicle adjacent said doors, said vehicle supported by at least two trucks, one said truck comprising a motorized truck, the other said truck comprising a supporting truck, said supporting truck including longitudinal beams each provided with a wheel at its opposite ends, said supporting truck wheels having a substantially smaller diameter than the diameter of the wheels of said motorized truck, a cross-beam extending between said longitudinal beams, bearing means joining one end of said cross-beam to one said longitudinal beam to permit articulation between said other longitudinal beam, said supporting truck located close to the end of one said frame section adjacent said articulation means connecting said two frame sections, the level of said floor of the vehicle at a right angle to the area corresponding to said supporting truck substantially lowered to provide ready access to and exit from said vehicle when said step is folded to a lowered position of use, said lowered floor having a flat surface extending longitudinally at least a majority of the length of said vehicle to a point adjacent said motorized truck, and said stringers supporting said floor extending from one end to the other end of that part of the vehicle where the floor is lowered and are located at the same level as said lowered floor.

* * * * *